US009963964B2

(12) United States Patent
Jones

(10) Patent No.: US 9,963,964 B2
(45) **Date of Patent: *May 8, 2018**

(54) DOWNHOLE SENSOR TOOL FOR MEASURING BOREHOLE CONDITIONS WITH FIT-FOR-PURPOSE SENSOR HOUSINGS

(71) Applicant: TOOL JOINT PRODUCTS LLC, Houston, TX (US)

(72) Inventor: David B. Jones, Houston, TX (US)

(73) Assignee: Tool Joint Products LLC, Houston, TX (US)

( * ) Notice: Subject to any disclaimer, the term of this patent is extended or adjusted under 35 U.S.C. 154(b) by 389 days.

This patent is subject to a terminal disclaimer.

(21) Appl. No.: 14/746,778

(22) Filed: Jun. 22, 2015

(65) Prior Publication Data

US 2015/0369037 A1 Dec. 24, 2015

Related U.S. Application Data

(63) Continuation-in-part of application No. 13/047,436, filed on Mar. 14, 2011, now Pat. No. 9,062,531.

(51) Int. Cl.
*E21B 47/08* (2012.01)

(52) U.S. Cl.
CPC ..... *E21B 47/082* (2013.01)

(58) Field of Classification Search
CPC ..... E21B 47/082
See application file for complete search history.

(56) References Cited

U.S. PATENT DOCUMENTS

| | | | |
|---|---|---|---|
| 4,665,511 | A | 5/1987 | Rodney et al. |
| 5,130,950 | A | 7/1992 | Orban et al. |
| 5,200,705 | A | 4/1993 | Clark et al. |
| RE34,975 | E | 6/1995 | Orban et al. |
| 5,469,736 | A | 11/1995 | Moake |
| 7,168,507 | B2 | 1/2007 | Downton |
| 7,389,828 | B2 | 6/2008 | Ritter et al. |
| 7,434,631 | B2 | 10/2008 | Krueger |
| 7,513,147 | B2 | 4/2009 | Yogeswaren |
| 2008/0110253 | A1 | 5/2008 | Stephenson |
| 2008/0128175 | A1 | 6/2008 | Radford et al. |

FOREIGN PATENT DOCUMENTS

| | | |
|---|---|---|
| GB | 2460096 | 7/2010 |

*Primary Examiner* — Nicole Coy
(74) *Attorney, Agent, or Firm* — Andrew W. Chu; Craft Chu PLLC

(57) ABSTRACT

The present invention is a system and method for measuring borehole conditions, in particular for verification of a final diameter of a borehole. The system includes a drill string with a drill bit and a drilling mud circulation device, an underreamer attached to the drill string above the drill bit, and a tool body attached to the drill string, having a sensor for detecting downhole conditions, such as borehole diameter. The tool body is mounted above the underreamer and has a diameter smaller than the underreamer and drill bit. The sensor can be an ultrasonic transducer with a sensor housing for adjustable distance to particular borehole size. The system may also include a calibrator for sensor data, and an auxiliary tool body with another sensor between the drill bit and the underreamer.

18 Claims, 4 Drawing Sheets

DOWNHOLE SENSOR TOOL FOR MEASURING BOREHOLE CONDITIONS WITH FIT-FOR-PURPOSE SENSOR HOUSINGS

RELATED U.S. APPLICATIONS

The present application claims continuation-in-part priority under 35 U.S.C. § 120 from U.S. Ser. No. 13/047,436, filed on 14 Mar. 2011, and entitled "SYSTEM AND METHOD FOR MEASURING BOREHOLE CONDITIONS, IN PARTICULAR, VERIFICATION OF A FINAL BOREHOLE DIAMETER".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to measuring features and conditions of boreholes of wellbores in the oil and gas industry. More particularly, the present invention relates to a system for taking measurement of a diameter of the borehole after drilling and underreaming the borehole. The present invention also relates to a system for taking measurement of a diameter of the borehole simultaneous with drilling and underreaming the borehole. Additionally, the present invention relates to a fit-for-purpose adjustment for taking measurements of different size boreholes.

2. Description of Related Art Including Information Disclosed Under 37 CFR 1.97 and 37 CFR 1.98.

Drilling is part of a process for extracting a natural resource, such as ground water, natural gas, and petroleum, or for exploring the nature of the material underground. A well or borehole can be created by use of a drilling rig to rotate a drill string, which has a drill bit attached at its end in order to bore into the ground to a desired depth. Drill collars and drill pipe sections add length, weight and support along the drill string as the borehole deepens, and different types of drill bits cut into all types of rock formations and soil combinations. Drilling fluid or drilling mud pumps through the inside of the string, out of the drill bit by nozzles or jets, and up the annulus to the surface, in order to create the proper physical and hydrostatic conditions to safely drill the well. Additionally, the rock cuttings are removed from the borehole in the drilling mud circulation flowing to the surface.

After drilling a section of hole, steel casings, which are slightly smaller in diameter than the borehole diameter, are placed in the hole. Cement can be injected in the annular space between the outside of the casings and the borehole. The casing system strengthens the integrity of the new section of the borehole to allow for deeper drilling and other benefits. A series of smaller and smaller drill bits with corresponding smaller steel casing systems are used for drilling, such that a completed well includes holes within holes. In the prior art technology, the diameter of the borehole decreases as each section of the casing systems are put in place.

However, the latest developments in drilling require deeper and deeper wells, even super deep wells from holes five to six miles below the surface. The continuing reliance upon fossil fuels, in particular oil and gas, has pushed the drilling and exploration industry to explore ultra deep waters (water depths more than 2000 m) with super deep wells drilled to depths over more than 7500 m. The temperature, distance, and pressure conditions of super deep wells require a vast amount of resources to extract oil and gas. The newly extreme depths cannot be reached with the prior art technology because the decreasing size of the diameter of the borehole set a limit on the depth of drilling.

The industry response to form super deep boreholes has been reaming or under-reaming, which enlarges the diameter of the borehole by removing a layer of the already stressed and disturbed material caused by the drill bit. Reaming has been known in metalworking and machining to affect mechanical properties for a good surface finish. Applied in the field of wellbore drilling, an underreamer is an activated cutting tool on the drill string to enlarge the borehole. The typical underreamer has a set of retractable and extendible parallel straight or helical cutting edges along the length of a cylindrical body and is placed higher than the drill bit along the drill string. The cutting edges have an angle and with a slight undercut below the cutting edges for making initial contact with the sides of the borehole.

The adaptation of underreamers has lead to even greater challenges in the oil and gas industry. Controlling the drill bit and the drill string in the borehole has always required special attention. Measurement While Drilling (MWD) and Logging While Drilling (LWD) systems collect real-time data, which is data viewed while drilling, and memory stored data, which is data viewed after the bit run. The data helps to ensure the proper direction and conditions of the drilling and record formation properties. MWD systems measure and record readings, such as natural gamma ray, borehole pressure, temperature, resistivity, formation density, etc., and the data can be transmitted as fast as real-time via mud pulser telemetry, wired drill pipe or other means. Stabilizers added on the drill string are mechanical solutions to reduce drill string vibrations, improve directional hole accuracy, and improve drilling efficiency. At the newly extreme distances and depths achieved with reamers, it becomes even more important for accurate monitoring because of the costs and resources invested, and it has become even more challenging with the underreamer positioned in the drill string. The underreamer is a separate cutting tool, so the drilling diameter of the drill bit and the larger final diameter, after the underreamer, are different. The prior art does not provide for the final confirmation of borehole diameter, after the underreamer and while drilling.

For measuring the borehole diameter, the present typical system is a wireline mechanical caliper tool, which collects a caliper log of the tracked measurements of the size and shape of a borehole, after drilling the hole section has been completed and after the drill string and drill bit have been removed from the well. The borehole diameter is an extremely vital piece of information for super deep wells because the borehole must be a particular size in order to fit the proper casing system. The extreme depths required cannot be achieved, if the boreholes become too small for the casings. The extending stacking of the casings cannot be supported or selected correctly if the borehole dimensions are too small. The wireline mechanical caliper tool verifies the borehole diameter as it is opened and withdrawn from the bottom of the hole; two or more articulated arms push against the walls of the borehole, taking hole diameter measurements. This prior art wireline mechanical caliper tool requires complete stoppage of the drilling operation and withdrawal of all drilling equipment from the borehole. As such, the wireline mechanical caliper tool and the method of using the caliper tool are very significant in terms of rig time and efficiency for the well.

In the past, various patents have been issued in the field of borehole diameter measurement. For example, U.S. Pat. No. 7,168,507, issued to Downton on Jan. 30, 2007, and published as 20030209365, discloses an invention to recalibrate downhole sensors. A first set of inexpensive and small sensors are located in the drill string adjacent to the bit, and a second set of more accurate sensors is located in a more protected location higher in the drill string away from the drill bit. As drilling progresses, the second set collects data to calibrate an offset of the first set of sensors. The invention discloses the placements of sensors away from the drill bit for better accuracy to measure for gas influx into the borehole.

U.S. Pat. No. 5,200,705, issued to Clark, et al. on Apr. 6, 1993, teaches a system for determining a dip characteristic of formations surrounding a borehole and a method of using a transducer array having longitudinally spaced transducers. The electrodes are located on the stabilizer blades to detect electric current from the coil antennas on a drill collar above the stabilizers. The electrodes on the stabilizer blades function as a sensor for electric current.

U.S. Pat. No. 5,130,950, issued to Orban, et al. on Jul. 14, 1992, describes an ultrasonic measurement apparatus. This patent is one of several similar patents relating to measuring characteristics in boreholes. The '950 patent clearly discloses the placement of a sensor in a stabilizer, even though no reamer is shown. FIG. 1 shows a stabilizer 27 with a sensor 45. This prior art only measures the pilot hole.

United States Patent Application Publication No. 20080110253, published by Stephenson, et al. on May 15, 2008, discloses an invention for downhole measurement of substances in formations while drilling. The method includes waiting for substance that is dissolved in the drilling fluid to be in equilibrium with any of the substance in the earth formation cuttings and measuring the substance dissolved in the drilling fluid downhole. FIG. 1 shows a sensor 99 placed away from the drill bit 15 and above the stabilizer 140.

U.S. Pat. No. 7,434,631, issued to Krueger, et al. on Oct. 14, 2008, teaches an apparatus and method of controlling motion and vibration of an NMR sensor in a drilling BHA. The sensor is disposed in the drilling assembly for making a measurement of a formation parameter of interest. A non-rotating stabilizer is disposed in the drilling assembly proximate the sensor. The non-rotating stabilizer is adapted to reduce motion of the sensor below a predetermined level during the measurement. This invention embodies the prior art with the sensor locked in a single non-rotating position on the drill string, so the errors in readings occur.

UK Patent Application, GB 2460096, published on Nov. 18, 2009, by Wajid, discloses an underreamer and caliper tool having means for determining bore diameter. In this publication, the tool integrates the enlargement of the borehole and measurement of the borehole diameter. The tool body attaches to the drill string and has expansion elements housing the caliper. The expansion elements are the cutting tool after the drill bit, and sensors measure borehole diameter during or after the underreaming. The specialized expansion elements with real-time data allow for control of the underreaming process.

At present, there is no LWD (Logging While Drilling) equipment available, that is dedicated to measurement during drilling and underreaming, i.e. MWD (Measurement While Drilling) systems, to determine the final well-bore diameter of any hole section that has been drilled. Many companies claim to be able to provide 'Real Time Well-Bore Diameter Measurements', but in reality, such data is apparently an 'inferred' reading, or a 'pseudo' caliper reading, such that the accuracy is questionable. The problem seems to be associated with a number of factors: the changing composition of the drilling mud affects the reading, the borehole is irregularly shaped, and the position of the bottom hole assembly and the sensors are not usually equidistant to the borehole wall, such that the reading depends upon the position of the sensor.

It is an object of the present invention to provide a system and method for measuring features and conditions of a borehole. Diameter of a borehole is one such condition of the borehole to be measured by the present invention. Other features and conditions of MWD tools may be adapted into the system and method of the present invention.

It is an object of the present invention to provide a system and method for verification of a borehole. In particular, the system measures while drilling or underreaming or both.

It is an object of the present invention to provide a system and method for verification of a borehole during drilling and underreaming in real time.

It is another object of the present invention to eliminate the need for separate caliper measurements of the final borehole.

It is still another object of the present invention to provide a system and method for verification of a final borehole compatible with existing technology.

It is an object of the present invention to provide a system and method for verification of a final borehole for any drilling and/or expansion operation of a wellbore.

It is another object of the present invention to provide a system and method for verification of a borehole with calibration means. In particular, the calibration means includes both a downhole and surface system for calibration of the sensor readings.

It is a further object of the present invention to provide a system and method for verification of a borehole with adjustment for different size boreholes.

It is an object of the present invention to provide a system and method for verification of a borehole with improved accuracy of final borehole measurements.

It is another object of the present invention to provide a system and method for verification of a borehole to monitor the efficiency of the underreamer.

It is another object of the present invention to provide a system and method for verification of a borehole, which stabilizes the drill string while measuring the final borehole diameter.

It is still another object of the present invention to provide a system and method for verification of a final borehole in a cost effective and efficient manner.

These and other objects and advantages of the present invention will become apparent from a reading of the attached specification and appended claims.

SUMMARY OF THE INVENTION

The present invention is a system and method for measuring conditions of a borehole, in particular diameter of a section of a borehole while drilling and while underreaming. The system of the present invention comprises a drill string, an underreaming means, and a tool body with a sensor. The drill string has a bottom hole assembly with a drill bit at a terminal end thereof and a circulation means for the drilling mud. The underreaming means or underreamer is attached to the drill string above the drill bit and has a passage for flow of the drilling mud. There are cutting edges on the underreaming means so as to enlarge a diameter of the borehole after being drilled by the drill bit of the bottom hole assembly. The tool body also attaches to the drill string, and the sensor detects the downhole conditions, such as the diameter of the borehole. The tool body is mounted above the underreaming means and has a diameter smaller than the underreaming means. The tool body is rotatably and axially aligned with the drill string, so that flow of the drilling mud is within the drill string, through the inside of the tool body, and then outside of an outer shell body of the tool body and up to the surface. There can also be a plurality of stabilizer blades for drill string stabilization.

The sensor means can be comprised of an ultrasonic transducer and a sensor housing. The ultrasonic transducer has adjustable signal amplitude so as to measure diameter of the borehole. The sensor housing as an inner face and an outer face. The ultrasonic transducer is mounted on the outer face. The outer face can protrude from the tool body to get closer to borehole walls for a more accurate and precise measurement. The tool body has a sleeve and a sensor body. The sleeve houses the regular components for the communication and storage of the sensor data and communicates or connects to the sensor means in the sensor body. Additionally, there is a means for communicating information from the downhole location to a surface location. Any known transmission method, such as downhole to surface telemetry sub, mud pulsar or wireless connection link to third party pulsar, or wired pipe, can be used.

The system of the present invention may also include a means for calibrating the sensor on the tool body. When the circulation means for the drilling mud reaches the surface location, there is a return mud flow line. The means for calibrating interacts with this return mud flow line or with the mud through the drill string. The calibrating means for the sensor is comprised of transducers on an interior passage of the tool body in fluid connection to the circulation system of the drilling mud through the drill string and/or on a surface location in fluid connection with the circulation system of the drilling mud. A first ultrasonic transducer on the interior can be in the inner passage of mud flow through the sleeve and sensor body of the tool body, and a second ultrasonic transducer on the surface can be in the mud flow line at the surface location. A processor for comparing data from the first and second transducers allows adjustment of the sensor readings for more accurate data and therefore improved drilling efficiency. The transducers for the sensor can be similar to the transducers for the calibrator.

The system of the present invention may also include an auxiliary tool body attached to the drill string. The auxiliary tool body has an auxiliary sensor means for detecting downhole conditions, which functions analogous to the sensor means on the tool body. The auxiliary tool body is mounted between the underreaming means and the bottom hole assembly with the drill bit, such that the readings of the auxiliary sensor are from a different downhole location than the sensor means of the tool body. The auxiliary sensor can also be correspondingly adjusted by the calibrating means in a similar manner.

DETAILED DESCRIPTION OF THE DRAWINGS

Figure 1:
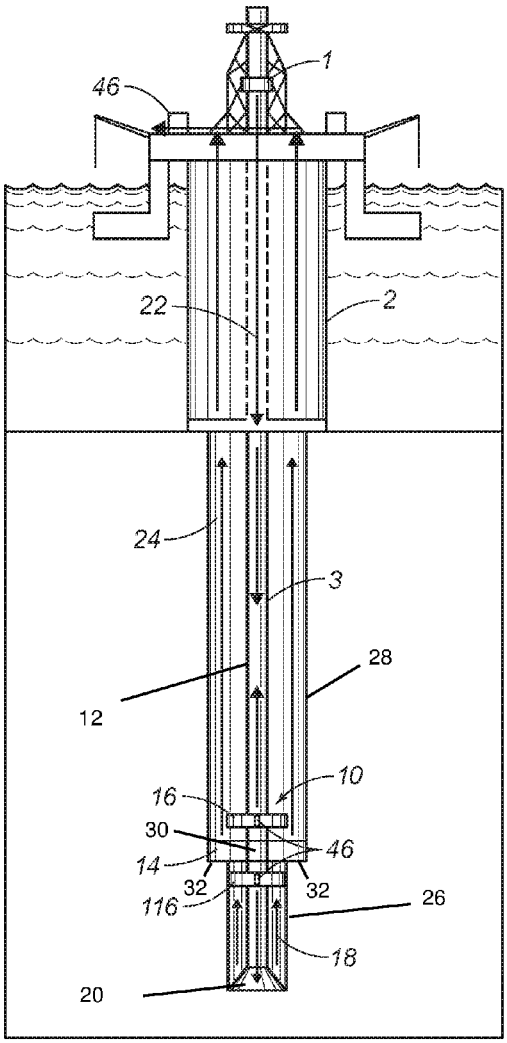
FIG. 1 is a schematic view of a deep water drilling rig, showing the system of the present invention.

FIG. 1 shows a deep water drilling rig 1, marine riser 2 and hole section 3 for a typical subsea well. These structures are used in super deep drilling as well. The system 10 for measuring borehole conditions, such as verification of a borehole diameter, of the present invention is shown in the hole section 3. The system 10 includes a drill string 12, an underreaming means 14, and a tool body 16. FIG. 1 shows an embodiment with the auxiliary tool body 116 also. The drill string 12 has a bottom hole assembly 18 with a drill bit 20 at a terminal end thereof. The drill string 12 also includes a circulation means 22 for drilling mud 24. The circulation means 22 can be a pump in flow path or any known system for moving drilling mud 24 through a drill string 12. The underreaming means 14 attaches to the drill string 12 above the drill bit 20 so that the portions of the pilot borehole 26 are differentiated from the reamed borehole 28. The underreaming means 14 is compatible with the circulation means 22 and maintains a passage 30 for flow of the drilling mud 24 through the underreaming means 14. Importantly, the underreaming means 14 has activatable cutting edges 32 so as to enlarge a diameter of the pilot borehole 26 after being drilled by the drill bit 20 of the bottom hole assembly 18.

Figure 2:
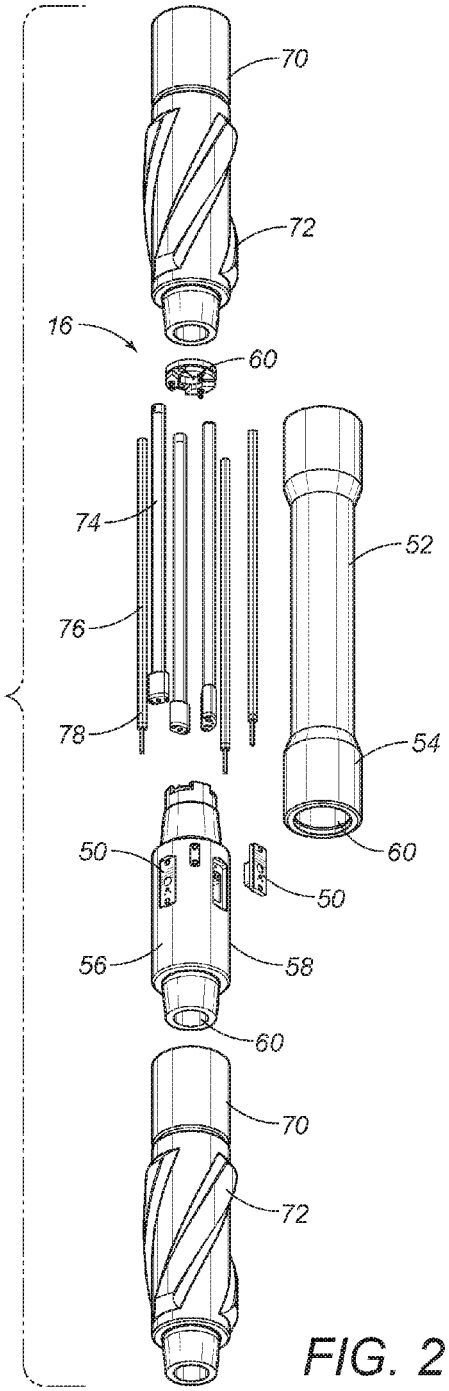
FIG. 2 is an exploded perspective view of the tool body and blade bodies of one embodiment of the present invention.
Figure 3:
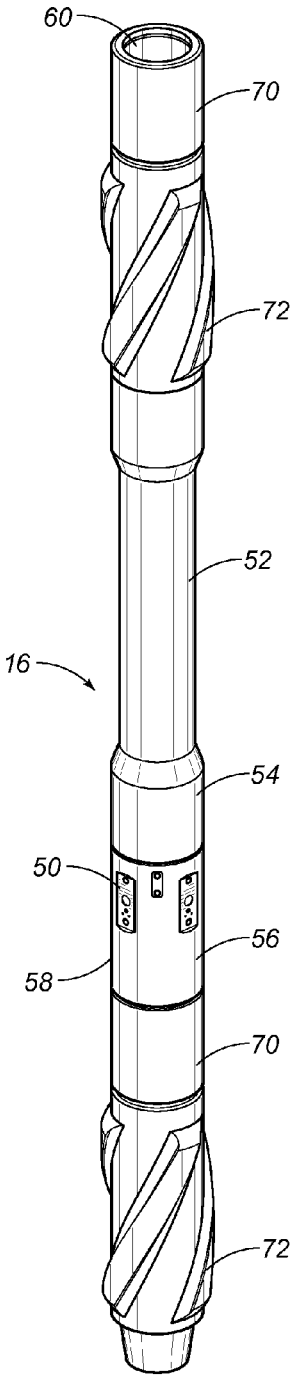
FIG. 3 is an assembled perspective view of the tool body and blade bodies of the embodiment of FIG. 2.
Figure 4:
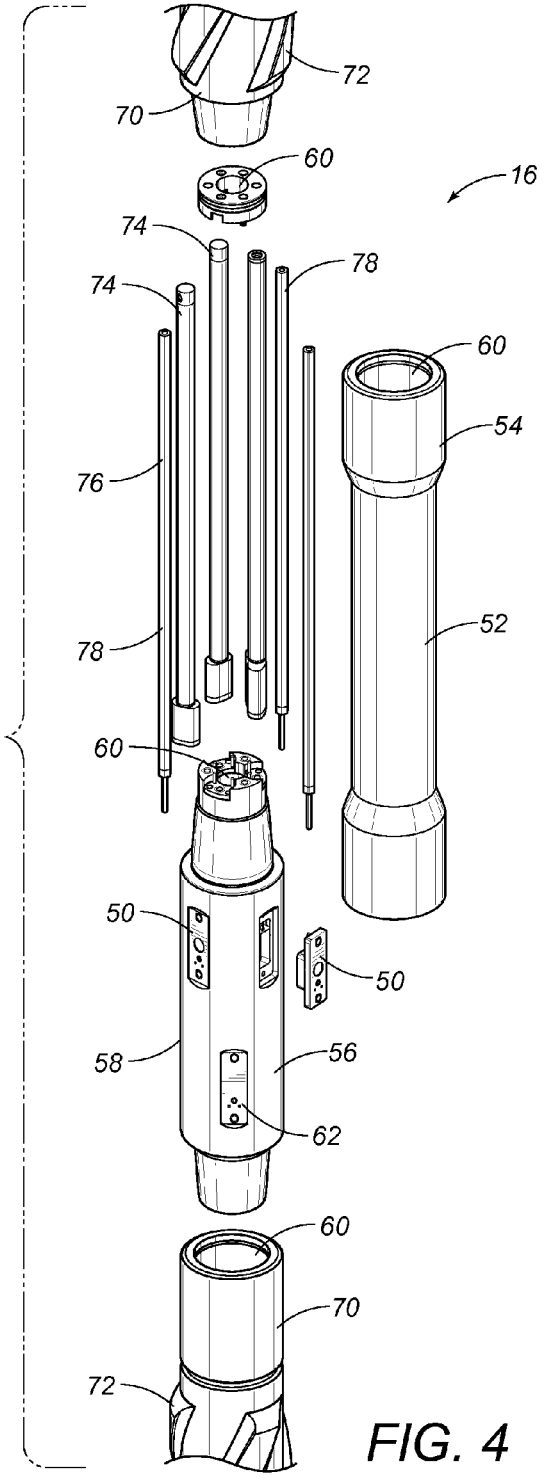
FIG. 4 is a magnified partial perspective view of the tool body and blade bodies of the embodiment of FIG. 2.
Figure 5:
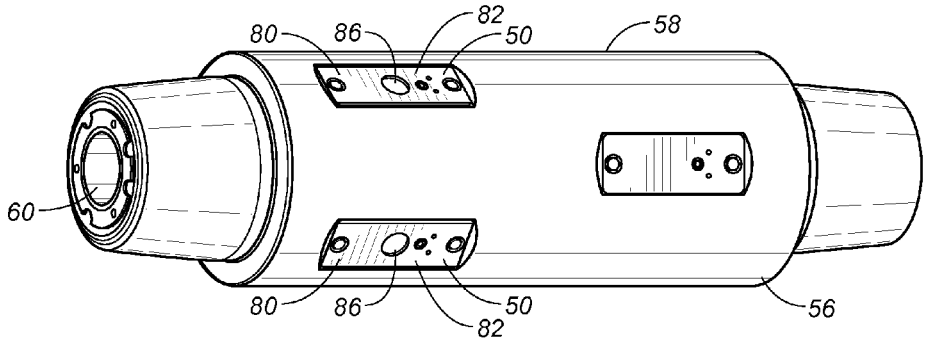
FIG. 5 is a perspective view of an embodiment of the sensor body of the tool body, showing the calibration means of the present invention.

FIG. 2 FIGS. 2-4 shows the tool body 16. Embodiments of the tool body 16 are mounted above the underreamer 14 and have a set diameter smaller than the underreamer 14 so as to avoid contact with walls of the borehole and to maintain rigidity of the drill string. In the present invention, the tool body 16 comprises a sleeve 52 being comprised of a tubular member 54, and a sensor body 56 with a means for detecting downhole conditions 50 on an outer surface 58 of the sensor body 56. The sleeve 52 is affixed onto the sensor body 56 by known means, such as welding, friction fit or screw fit. The sleeve 52 is connected to the sensor body 56 physically and electronically so that the sleeve 52 and sensor body are made integral. There is also electronic communication between the sleeve 52 and the sensor body 56 so that components housed in each are connected. The tool body 16 has an inner passage 60 for flow of the drilling mud 24 through the sleeve 52 and the sensor body 56. There are also means for attachment to the drill string 12 on the sleeve 52 and the sensor body 56. The tool body 16 remains rotatably and axially aligned with the drill string 12. The tool body 16 is separate from the underreamer 14 along the drill string 12. The drilling mud 24 flows along an outside of the sleeve 52 and the sensor body 56 and within the drill string 12 through the inner passage 60 of the tool body 16.

FIGS. 4-7 show the calibration means 62, along the circulation means 22 for drilling mud 24 with a mud flow line at a surface location. The calibration means 62 or means for calibrating the means for detecting downhole conditions 50 is mounted on the sensor body 56. The calibration means 62 includes a first ultrasonic transducer 64 housed on the outer surface 58 of the sensor body 56 for measuring within the inner passage 60 in fluid connection to the circulation system 22 of the drilling mud 24 through the drill string 12. The first transducer being contained in the sensor body 56 with an orientation to measure inward toward the inner passage 60. The transducer 64 is oriented opposite the means for detecting downhole conditions 50. There is also processing means, such as a computer, for comparing data from the first transducer 64 so as to allow adjustment of drilling.

The first ultrasonic transducer 64 measures within the inner passage 60 for flow with a fixed gap spacing slot with a known diameter, transmitting a reading across the known diameter toward the inner passage 60 from the outer surface 58 of the sensor body 56 during drilling so as to continuously record the reading across the known diameter for comparing drilling mud 24 at the first ultrasonic transducer 64 downhole to the drilling mud 24 at the means for detecting downhole conditions 50. The readings indicate need for an adjustment of readings of the means for detecting dowhole conditions 50 of the tool body 16.

FIGS. 2-4 show embodiments of the system 10 with a blade body 70. The blade body 70 attaches to at least the sleeve 52 or the sensor body 56. FIGS. 2-4 shows a blade body 70 on each of the sleeve 52 and the sensor body 56. Each blade body 70 has a plurality of stabilizer blades 72. The stabilizer blades 72 are fixed relative to the blade body 70, the sleeve 52 and the sensor body 56. FIGS. 2-4 shows the stabilizer blades 72 as twisting ridges parallel to the blade body 70. Stabilizer blades 72 can have various shapes. In the invention, a maximum diameter of the stabilizer blades 72 on the blade body 70 is smaller than a diameter of the reaming blades of the underreamer 14 and the drill bit so as to avoid contacting the walls of the borehole and enlarging the borehole. The stabilizer blades 72 are non-cutting protrusions aligned with the drill string 12 maintaining rigidity of the drill string 12. The maximum diameter of the stabilizer blades 72 extends further from the blade body 70, the sleeve 52 and the sensor body 56 than the means for detecting 50 so as to shield the means for detecting 50. In various embodiments, the system 10 may have one blade body 70 or multiple blade bodies 70, and the blade bodies 70 can be attached at the sleeve 52 or the sensor body 56. For the embodiments with the auxiliary tool body 116, there can be respective auxiliary blade bodies incorporated into the system 10.

FIG. 2-4 also show the sleeve 52 housing a power supply means 74, circuitry 76, and memory storage means 78 for sensor data. In some embodiments, the tubular member 54 of the sleeve 52 can have a side wall with a plurality of through holes for the power supply means 74, the circuitry 76, and the memory storage means 78 for sensor data. The inner passage 60 is defined by the side wall extending through the sleeve 52. In other embodiments, there is a cap 79 for alignment of the power supply means 74, the circuitry 76, and the memory storage means 78 for sensor data within the tubular member 54. The cap 79 holds the components in place, and the inner passage 60 still flows through the sleeve 52.

Figure 6:
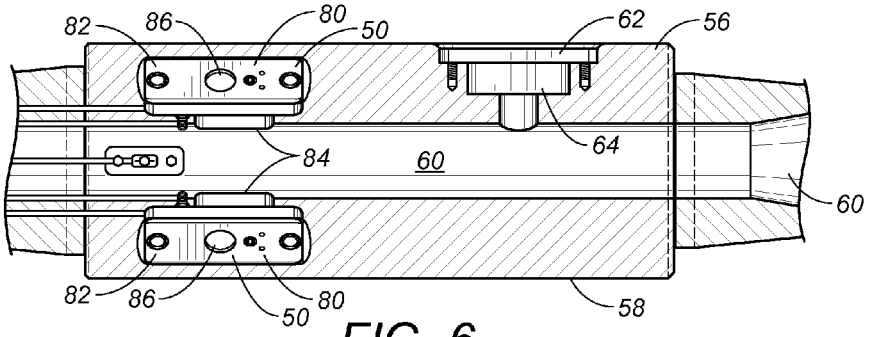
FIG. 6 is a partial cross-sectional view of the sensor body of the tool body, showing the calibration means of FIG. 5.
Figure 7:
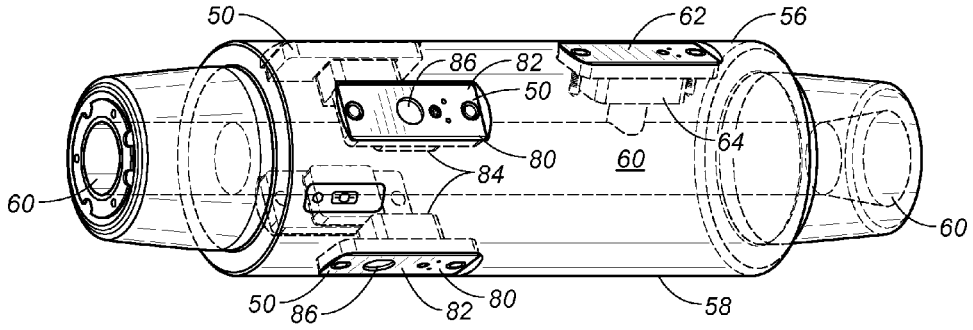
FIG. 7 is another perspective view of the sensor body of the tool body, showing the calibration means of FIG. 5.
Figure 8:
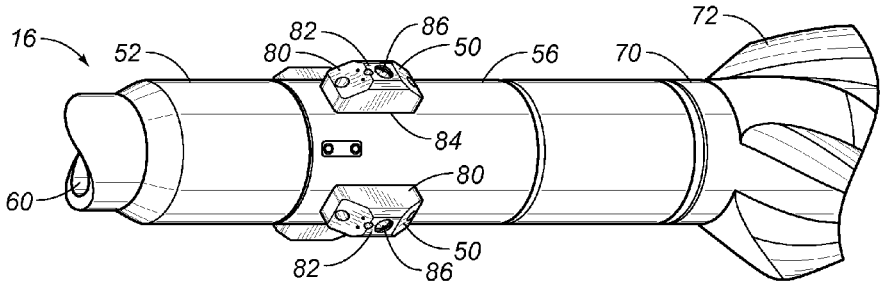
FIG. 8 is a perspective view of another embodiment of the sensor body of the tool body, showing the sensor housings and attachment to the sleeve and a blade body.
Figure 9:
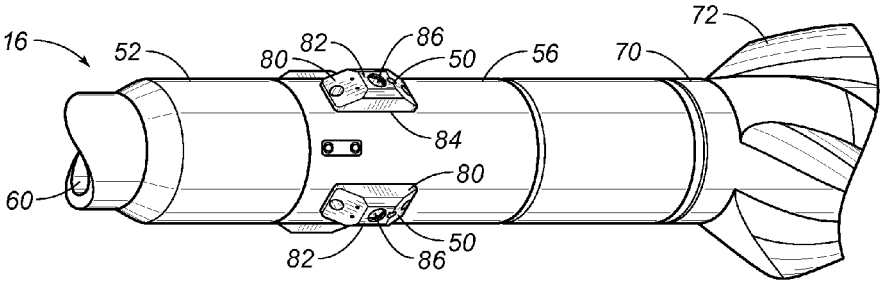
FIG. 9 is another perspective view of the embodiment of the sensor body of the tool body of FIG. 8, showing a different embodiment of the sensor housings.
Figure 10:
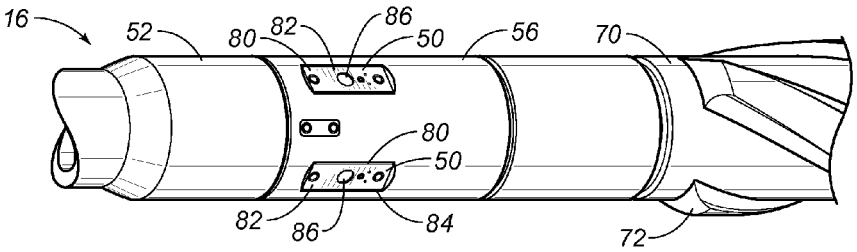
FIG. 10 is still another perspective view of the embodiment of the sensor body of the tool body of FIG. 8, showing a still another different embodiment of the sensor housings.

FIGS. 6-10 show the embodiments of the system 10 with the means for detecting 50 comprised of at least one ultrasonic transducer 86 with adjustable signal amplitude so as to measure diameter of the borehole and a respective sensor housing 80 with an outer face 82 and an inner face 84. The at least one ultrasonic transducer 86 is mounted at the outer face 82. The ultrasonic transducer 86 can be comprised of a piezo-electric material. FIGS. 8 and 9 show embodiments of the outer face 82 of the sensor housing 80 protruding outward from the sensor body 56 so as to avoid contacting the walls of the borehole and enlarging the borehole. Without contacting the borehole, the sensor housing 80 reduces distance between the transducer 86 and the borehole wall, so that a more accurate measurement is taken. The sensor housing 80 is fit-for-purpose for different sizes of boreholes. The present invention can be utilized for different size boreholes without re-machining the entire tool body 16. FIGS. 6, 7, and 10 shows the outer face 82 almost flush with the outer surface 58 of the sensor body 56 for a reading further from the borehole. FIGS. 8-10 show that the outer face 82 of the sensor housing 80 protrudes outward from the sensor body 56 less than the maximum diameter of the stabilizer blades 72, when there is a blade body 70.

Embodiments of the invention also include a means for communicating information from a downhole location to a surface location in any component, such as the circuitry 76. The means for communicating being known downhole to surface telemetry sub, mud pulsar or wireless connection link to third party pulsar, or wired pipe and being housed in the sleeve.

FIG. 1 shows the calibration means 62 further including a second ultrasonic transducer 46 on a surface location in fluid connection with the circulation system 22 of the drilling mud 24, and in the mud flow line at the surface location. A processing means for comparing data from the second transducer 46 allows adjustment of drilling with additional data. The second transducer 46 can verify drilling mud interference at an additional location. The second ultrasonic transducer 46 is positioned at a surface location with a known diameter, transmitting a reading across the known diameter during drilling so as to continuously record the reading across the known diameter for comparing drilling mud at the second ultrasonic transducer 46 at the surface location to the drilling mud at the means for detecting 50. The readings indicate need for an adjustment of readings of the means for detecting 50 of the tool body 16. The second transducer 46 at the surface location can be comprised of a surface calibration block with known dimensions in the mud flow line, transmitting a reading across the calibration block, having a gate with a fixed distance so as to continuously record travel time across the fixed distance for comparing drilling mud at the surface location to the drilling mud at the means for detecting at a downhole location.

In another embodiment of the present invention, there is an auxiliary tool body 116 being mounted between the underreamer 14 and the drill bit as shown in FIG. 1. The auxiliary tool body 116 has analogous components to the tool body 16; however the readings and measurements are taken from a different relative location of the overall system. The auxiliary tool body 116 can have analogous features to the tool body 16, such that the auxiliary tool body 116 is virtually identical, except for placement in the drill string 12. The readings of the auxiliary tool body 116 provide pilot borehole readings similar to the prior art. In combination with the features of the present invention, the system 10 provides even more accuracy and advance notice of irregularities for the underreamer 14. For example, the operation of the underreamer 14 can anticipate a slower or faster drilling rate based upon the readings of the auxiliary tool body 116, which detect diameter deviations possibly due to rock formation or mud variations. The auxiliary tool body 116 can also contribute readings for the calibration means 46 in monitoring drilling mud 24 variations.

The system and method for measuring borehole conditions of the present invention improves the determination of the diameter of a borehole, after drilling and after underreaming in real time. The present invention takes an actual measurement, which is more accurate than the calculations of diameter, which currently may use algorithmic calculations. The present invention has real-time capability, in addition to stored memory, so that adjustments in the drilling program can be made before excessive expenses are incurred. Also, the drilling operation does not have to stop in order to run a wireline mechanical caliper through the borehole for a hole diameter log. Furthermore, the system of the present invention is compatible with existing technology and can be applied to any expansion operation of a wellbore. It is conceivable that reamer technology may advance with cutting edges and adjustable diameters, and the present invention can be integrated in any version of an underreamer and bottom hole assembly.

The system and method for verification of a borehole with calibration means is another important innovation. A downhole and surface calibration block allows changes in the drilling fluid, which is flowing down through the drill string and up the annulus, to be monitored, and the travel-time (echo signal or attenuation) over an unknown distance (sensor to bore-hole wall) can be automatically corrected to allow for any changes in the drilling fluid (mud) properties, by using the downhole calibration sensor and/or the calibration block sensor at the surface to make corrections to the changes in attenuation or time of flight of the stand-off (gap between sensor and bore-hole wall) due to changes in the drilling mud. The placement of the tool body is also a stabilizer for the drill string itself as well. The inside-out measurement of the transducer of the calibration means is an advantage downhole calibration, which protects the transducer, while taking useful readings. As a stabilizer with blade bodies, no actual drilling and reaming action is performed, which reduces risk of damage and disruption to the invention.

Another unique feature of this application, is the adjustment for different size boreholes. The sensor housings have variable outer faces. The system is fit-for-purpose for different size boreholes. A new tool body is not required for larger holes. The sensor housings can be larger and more protruded to get closer to the borehole, while still remaining on the same size tool body and still having a diameter less than a stabilizer blade and less than any reaming blade.

The present invention still includes the auxiliary system for the new tool body of the sleeve and sensor body construction. The sensor and auxiliary sensor in the bottom hole assembly provide data from above and below reaming, thereby enabling a comparison between lower and upper signal readings. A longer travel time (echo signal), through the mud column in the annulus, with the ultrasonic sensor, would indicate that the reamed hole is larger than the pilot hole, which has been drilled with the smaller diameter drill bit and will have a faster travel time (echo signal) indicating a smaller gap between the sensor and the borehole wall.

Another advantage of the real time data of the present invention is that the system can be focused on the final diameter of the borehole, and can be calibrated to the correct drilling mud properties. So, a more accurate reading of the annulus spacing between the sensors and the final (reamed) borehole wall will be achieved. The sensors will operate and emit a continuous signal, thereby recording hole diameter information continuously, i.e. while the BHA (Bottom Hole Assembly) is rotating and moving down (i.e. while drilling), or whether moving up or down (i.e. while off bottom or tripping), or stationary (i.e. while circulating).

The system provides more accuracy and precision before and after underreaming, which monitors how well the underreamer functions. To enable this greater accuracy, the auxiliary tool body with auxiliary sensor can be run below the reamer, in the pilot hole, which allows a comparison between the pilot hole ultrasonic signal below the reamer and the reamed hole ultrasonic signal in the larger diameter reamed hole. These ultrasonic signal readings will be tracked against time and drilled depth, for comparison, and the data will give indications of whether the reamer is cutting a correct gauge hole size, or whether the underreamer or reamer has failed to activate, so the 'pilot hole' and 'reamed hole' ultrasonic signals will be the same, showing that the borehole diameters are the same.

As such, the system and method of the present invention provide a cost effective and efficient alternative to the prior art technology.

The foregoing disclosure and description of the invention is illustrative and explanatory thereof. Various changes in the details of the illustrated construction can be made without departing from the true spirit of the invention.

I claim:

1. A system for measuring borehole conditions, the system comprising:

a drill string having a bottom hole assembly with a drill bit at a terminal end thereof and a circulation means for drilling mud;

an underreamer attached to the drill string above the drill bit and having a passage for flow of the drilling mud, the underreamer being comprised of a reamer body and a plurality of reaming blades, the reaming blades having cutting surfaces so as to contact and ream walls of the borehole, enlarging the borehole after drilling by the drill bit; and a tool body being mounted above the underreamer and having a set diameter smaller than the underreamer so as to avoid contact with walls of the borehole and to maintain rigidity of the drill string, the tool body comprising:

a sleeve being comprised of a tubular member;

a sensor body with a means for detecting downhole conditions on an outer surface of said sensor body, said sleeve being affixed onto said sensor body and being connected to said sensor body, wherein said tool body has an inner passage for flow of the drilling mud through said sleeve and said sensor body; and a means for attachment to the drill string on said sleeve and said sensor body, wherein the tool body is rotatably and axially aligned with the drill string, the tool body being separate from the reamer body along the drill string, the flow of the drilling mud being along an outside of said sleeve and said sensor body and within the drill string through said inner passage of said tool body, wherein the circulation means for drilling mud has a mud flow line at a surface location, the system further comprising:

means for calibrating the means for detecting, the means for calibrating comprising:

a first ultrasonic transducer housed on said outer surface of said sensor body for measuring within said inner passage in fluid connection to the circulation system of the drilling mud through the drill string, the first transducer being contained in said sensor body with an orientation to measure inward toward said inner passage, the transducer oriented opposite said means for detecting downhole conditions; and processing means for comparing data from the first transducer so as to allow adjustment of drilling, wherein the first ultrasonic transducer measures within said inner passage for flow with a fixed gap spacing slot with a known diameter, transmitting a reading across the known diameter toward said inner passage from said outer surface of said sensor body during drilling so as to continuously record the reading across the known diameter for comparing drilling mud at the first ultrasonic transducer downhole to the drilling mud at the means for detecting downhole conditions; and wherein readings indicate need for an adjustment of readings of the means for detecting of the tool body.

2. The system for measuring borehole conditions, according to claim 1, further comprising:

a blade body attached to at least said sleeve or said sensor body, said blade body having a plurality of stabilizer blades, said stabilizer blades being fixed relative to said blade body, said sleeve and said sensor body, wherein a maximum diameter of said stabilizer blades on said blade body is smaller than a diameter of said reaming blades, said underreamer and said drill bit so as to avoid contacting said walls of said borehole and enlarging said borehole, wherein said stabilizer blades are non-cutting protrusions aligned with the drill string maintaining rigidity of said drill string, and wherein said maximum diameter of said stabilizer blades extends further from said blade body, said sleeve and said sensor body than said means for detecting so as to shield said means for detecting.

3. The system for measuring borehole conditions, according to claim 1, further comprising:

a plurality of blade bodies attached to said sleeve and said sensor body, each blade body having a plurality of stabilizer blades, said stabilizer blades being fixed relative to each blade body, said sleeve and said sensor body, wherein a maximum diameter of said stabilizer blades on each blade body is smaller than a diameter of said reaming blades, said underreamer and said drill bit so as to avoid contacting said walls of said borehole and enlarging said borehole, wherein said stabilizer blades are non-cutting protrusions aligned with the drill string maintaining rigidity of said drill string, and wherein said maximum diameter of said stabilizer blades extends further from each blade body, said sleeve and said sensor body than said means for detecting so as to shield said means for detecting.

4. The system for measuring borehole conditions, according to claim 1, wherein said sleeve houses a power supply means, circuitry, and memory storage means for sensor data.

5. The system for measuring borehole conditions, according to claim 4, wherein said tubular member of said sleeve has a side wall with a plurality of through holes for said power supply means, said circuitry, and said memory storage means for sensor data, said inner passage being defined by said side wall extending through said sleeve.

6. The system for measuring borehole conditions, according to claim 1, wherein said means for detecting is comprised of at least one ultrasonic transducer with adjustable signal amplitude so as to measure diameter of said borehole and a respective sensor housing with an outer face and an inner face, said at least one ultrasonic transducer being mounted at said outer face.

7. The system for measuring borehole conditions, according to claim 6, wherein the ultrasonic transducer is comprised of a piezo-electric material.

8. The system for measuring borehole conditions, according to claim 6, wherein said outer face of said sensor housing protrudes outward from said sensor body so as to avoid contacting said walls of said borehole and enlarging said borehole.

9. The system for measuring borehole conditions, according to claim 6, further comprising:

a blade body attached to at least said sleeve or said sensor body, said blade body having a plurality of stabilizer blades, said stabilizer blades being fixed relative to said blade body, said sleeve and said sensor body, wherein a maximum diameter of said stabilizer blades on said blade body is smaller than a diameter of said reaming blades, said underreamer and said drill bit so as to avoid contacting said walls of said borehole and enlarging said borehole, wherein said stabilizer blades are non-cutting protrusions aligned with the drill string maintaining rigidity of said drill string, and wherein said maximum diameter of said stabilizer blades extends further from said blade body, said sleeve and said sensor body than said means for detecting so as to shield said means for detecting, and wherein said outer face of said sensor housing protrudes outward from said sensor body less than said maximum diameter of said stabilizer blades.

10. The system for measuring borehole conditions, according to claim 1, further comprising:

means for communicating information from a downhole location to a surface location, said means for communicating being known downhole to surface telemetry sub, mud pulsar or wireless connection link to third party pulsar, or wired pipe and being housed in said sleeve.

11. The system for measuring borehole conditions, according to claim 1, wherein said circulation means for drilling mud has a mud flow line at a surface location, said system further comprising:

means for calibrating said means for detecting, said means for calibrating further comprising:

a second ultrasonic transducer on a surface location in fluid connection with said circulation system of said drilling mud, and in said mud flow line at said surface location; and processing means for comparing data from the second transducer so as to allow adjustment of drilling, wherein said second ultrasonic transducer is positioned at a surface location with a known diameter, transmitting a reading across said known diameter during drilling so as to continuously record said reading across said known diameter for comparing drilling mud at said second ultrasonic transducer at the surface location to said drilling mud at said means for detecting, and wherein readings indicate need for an adjustment of readings of said means for detecting of said tool body.

12. The system for measuring borehole conditions, according to claim 11, wherein said second transducer at the surface location is comprised of a surface calibration block with known dimensions in said mud flow line, transmitting a reading across the calibration block, having a gate with a fixed distance so as to continuously record travel time across said fixed distance for comparing drilling mud at said surface location to said drilling mud at said means for detecting at a downhole location.

13. A system for measuring borehole conditions, the system comprising:

a drill string having a bottom hole assembly with a drill bit at a terminal end thereof and a circulation means for drilling mud;

an underreamer attached to the drill string above the drill bit and having a passage for flow of the drilling mud, the underreamer being comprised of a reamer body and a plurality of reaming blades, the reaming blades having cutting surfaces so as to contact and ream walls of the borehole, enlarging the borehole after drilling by the drill bit;

a tool body being mounted above the underreamer and having a set diameter smaller than the underreamer so as to avoid contact with walls of the borehole and to maintain rigidity of the drill string, the tool body comprising:

a sleeve being comprised of a tubular member;

a sensor body with a means for detecting downhole conditions on an outer surface of said sensor body, said sleeve being affixed onto said sensor body and being connected to said sensor body, wherein said tool body has an inner passage for flow of the drilling mud through said sleeve and said sensor body; and a means for attachment to the drill string on said sleeve and said sensor body, wherein the tool body is rotatably and axially aligned with the drill string, the tool body being separate from the reamer body along the drill string, the flow of the drilling mud being along an outside of said sleeve and said sensor body and within the drill string through said inner passage of said tool body; and an auxiliary tool body being mounted between the underreamer and the drill bit, the auxiliary tool body having a set diameter smaller than the underreamer so as to avoid contacting with walls of the borehole and to maintain rigidity of the drill string, the tool body being located on an opposite side of the underreamer than the auxiliary tool body, said auxiliary tool body comprising:

an auxiliary sleeve being comprised of an auxiliary tubular member;

an auxiliary sensor body with an auxiliary means for detecting downhole conditions on an auxiliary outer surface of said auxiliary sensor body, said auxiliary sleeve being affixed onto said auxiliary sensor body and being connected to said auxiliary sensor body, wherein said auxiliary tool body has an auxiliary inner passage for flow of the drilling mud through said auxiliary sleeve and said auxiliary sensor body;

an auxiliary means for attachment to the drill string on said auxiliary sleeve and said auxiliary sensor body; and an auxiliary means for communicating information from a downhole location to the surface location, the auxiliary means for communicating being known downhole to surface telemetry sub, mud pulsar or wireless connection link to third party pulsar, or wired pipe, wherein the auxiliary tool body is rotatably and axially aligned with the drill string, the auxiliary tool body being separate from the reamer body along the drill string, the flow of the drilling mud being along an outside of said auxiliary sleeve and said auxiliary sensor body and within the drill string through said auxiliary inner passage of said auxiliary tool body.

14. The system for measuring borehole conditions, according to claim 13, further comprising:

a plurality of blade bodies attached to said sleeve and said sensor body of said tool body and said auxiliary sleeve and said auxiliary sensor body of said auxiliary tool body, each blade body having a plurality of stabilizer blades, said stabilizer blades being fixed relative to each blade body, said sleeve and said sensor body, wherein a maximum diameter of said stabilizer blades on each blade body is smaller than a diameter of said reaming blades, said underreamer and said drill bit so as to avoid contacting said walls of said borehole and enlarging said borehole, wherein said stabilizer blades are non-cutting protrusions aligned with the drill string maintaining rigidity of said drill string, and wherein said maximum diameter of said stabilizer blades extends further from each blade body, said sleeve, said sensor body, said auxiliary sleeve, and said auxiliary sensor body than said means for detecting and said auxiliary means for detecting so as to shield said means for detecting and said auxiliary means for detecting.

15. The system for measuring borehole conditions, according to claim 13, wherein said circulation means for drilling mud has a mud flow line at a surface location, said system further comprising:

means for calibrating the means for detecting, the means for calibrating comprising:

a first ultrasonic transducer housed on said outer surface of said sensor body for measuring within said inner passage in fluid connection to the circulation system of the drilling mud through the drill string, the first transducer being contained in the sealed with an orientation to measure inward toward said inner passage, the transducer oriented opposite said means for detecting downhole conditions;

processing means for comparing data from the first transducer so as to allow adjustment of drilling; and said auxiliary means for detecting of said auxiliary tool body, wherein the first ultrasonic transducer measures within said inner passage for flow with a fixed gap spacing slot with a known diameter, transmitting a reading across the known diameter toward the passage from said outer surface of said sensor body during drilling so as to continuously record the reading across the known diameter for comparing drilling mud at the first ultrasonic transducer downhole to the drilling mud at the means for detecting downhole conditions; and wherein readings indicate need for an adjustment of readings of the means for detecting of the tool body.

16. The system for measuring borehole conditions, according to claim 13, wherein said means for detecting is comprised of at least one ultrasonic transducer with adjustable signal amplitude so as to measure diameter of said borehole and a respective sensor housing with an outer face and an inner face, said at least one ultrasonic transducer being mounted at said outer face, and wherein said auxiliary means for detecting is comprised of at least one auxiliary ultrasonic transducer with adjustable signal amplitude so as to measure diameter of said borehole and a respective auxiliary sensor housing with an auxiliary outer face and an auxiliary inner face, said at least one auxiliary ultrasonic transducer being mounted at said auxiliary outer face.

17. The system for measuring borehole conditions, according to claim 16, wherein said outer face of said sensor housing protrudes outward from said sensor body so as to avoid contacting said walls of said borehole and enlarging said borehole, and wherein said auxiliary outer face of said auxiliary sensor housing protrudes outward from said auxiliary sensor body so as to avoid contacting said walls of said borehole and enlarging said borehole.

18. The system for measuring borehole conditions, according to claim 16, further comprising:

a plurality of blade bodies attached to said sleeve and said sensor body of said tool body and said auxiliary sleeve and said auxiliary sensor body of said auxiliary tool body, each blade body having a plurality of stabilizer blades, said stabilizer blades being fixed relative to each blade body, said sleeve and said sensor body, wherein a maximum diameter of said stabilizer blades on each blade body is smaller than a diameter of said reaming blades, said underreamer and said drill bit so as to avoid contacting said walls of said borehole and enlarging said borehole, wherein said stabilizer blades are non-cutting protrusions aligned with the drill string maintaining rigidity of said drill string, and wherein said maximum diameter of said stabilizer blades extends further from each blade body, said sleeve, said sensor body, said auxiliary sleeve, and said auxiliary sensor body than said means for detecting and said auxiliary means for detecting so as to shield said means for detecting and said auxiliary means for detecting, wherein said outer face of said sensor housing protrudes outward from said sensor body less than said maximum diameter of said stabilizer blades, and wherein said auxiliary outer face of said auxiliary sensor housing protrudes outward from said auxiliary sensor body less than said maximum diameter of said stabilizer blades.

* * * * *